US007059514B1

(12) United States Patent
Peters et al.

(10) Patent No.: US 7,059,514 B1
(45) Date of Patent: Jun. 13, 2006

(54) LOTTERY-TYPE TICKET HAVING A WINNER INDICATION

(76) Inventors: Darin L. Peters, 7008 Hillview Dr., Plano, TX (US) 75025; Knowles B. Comwell, 15905 Ranchita, Dallas, TX (US) 75248; Steven W. Smith, 7237 Birchwood Dr., Dallas, TX (US) 75240

( * ) Notice: Subject to any disclaimer, the term of this patent is extended or adjusted under 35 U.S.C. 154(b) by 0 days.

(21) Appl. No.: 11/134,697

(22) Filed: May 20, 2005

(51) Int. Cl.
*G06F 17/00* (2006.01)

(52) U.S. Cl. ..... 235/375

(58) Field of Classification Search ..... 235/494, 235/375; 373/139, 292, 269, 138.1, 252
See application file for complete search history.

(56) References Cited

U.S. PATENT DOCUMENTS 5,494,317 A 2/1996 Johnson
6,145,885 A 11/2000 Scrymgeour et al.
6,347,794 B1 2/2002 Scrymgeour et al.
2003/0030211 A1* 2/2003 Brown ..... 273/139
2004/0227000 A1* 11/2004 Behm et al. ..... 235/487
2005/0258596 A1* 11/2005 Such ..... 273/269

* cited by examiner

*Primary Examiner*—Thien M. Le
*Assistant Examiner*—Thien T. Mai
(74) *Attorney, Agent, or Firm*—Steven W. Smith

(57) ABSTRACT

A lottery-type ticket having a winner indication that enables a player to quickly determine whether the ticket is a winning ticket. The ticket may be a scratch-off ticket or a break-open ticket. The winner indication may be hidden under a scratch-off zone or behind a pull-tab window that is independent and separated from the playing area. Alternatively, the winner indication may be proximate to one or more game indicia that are each hidden under a scratch-off zone or behind a pull-tab window. Speed of play is increased by enabling the player to determine whether the ticket is a winning ticket by either scratching off a single scratch-off zone or opening a single pull-tab window.

16 Claims, 2 Drawing Sheets

LOTTERY-TYPE TICKET HAVING A WINNER INDICATION

BACKGROUND OF THE INVENTION

1. Technical Field of the Invention

This invention relates to tickets for playing games of chance. More particularly, and not by way of limitation, the invention is directed to a lottery-type ticket having a winner indication that enables a player to quickly determine whether the ticket is a winning ticket.

2. Description of Related Art

As used herein, the term "lottery ticket" shall refer to tickets for playing games of chance such as lotteries, bingo games, and the like, wherein the tickets include one or more hidden indications or symbols (indicia) for playing the game. To play the game, the player must uncover the hidden indicia by, for example, opening a pull-tab window on a break-open ticket or scratching off an opaque surface material covering the indicia. Break-open tickets may be known variously as pull-tabs, pickle cards, jar tickets, hard cards, bingo tickets, and charitable gaming tickets.

Lottery tickets are well known and widely sold, and typically comprise a sheet material of paper or card stock on which is printed lottery information and various indicia for the playing of one or more games. Break-open tickets are typically constructed by printing a sheet containing multiple combinations of lottery indicia thereon. This sheet is then cut into sections. The opposite side of this sheet includes prize categories, serial numbers, and the like. A second sheet containing removable pull-tabs or break-open windows is then mounted onto the card stock such that the break-open windows overlap and hide the lottery indicia from view.

It is known in the art to use different types of security measures to ensure the validity of apparently winning tickets. For example, it is known in the art for break-open tickets to use a different background color in the area of the indicia when the ticket is a winning ticket. This prevents a dishonest player from cutting out a matching indication from a losing ticket and pasting it into another ticket to form a winning combination. In such a case, the fraudulent ticket can be recognized by the fact that the background color is not correct or does not match for all the indicia.

As another example, U.S. Pat. No. 5,494,317 discloses a lottery ticket in which multiple indicia for playing the game must match in order to have a winning ticket. As a security measure, one of the indicia is printed larger that the others when the ticket is a winning ticket. This again prevents a dishonest player from cutting out a matching indication from a losing ticket and pasting it into another ticket to form a winning combination. In such a case, the fraudulent ticket can be recognized by the fact that all of the winning indicia are the same size.

Although numerous methodologies have been developed for security purposes to counter fraud, there are no known improvements to lottery tickets for speeding up the play of the game. Many players purchase lottery tickets in large numbers, and are interested in determining as quickly as possible whether each ticket is a winning ticket. With existing lottery tickets, however, the player must uncover multiple indicia on each ticket by opening multiple windows or by scratching off multiple scratch-off zones in order to determine whether enough of the indicia match to be a winner.

Additionally, many people purchase large numbers of lottery tickets to give to friends and family members as birthday or holiday presents. There is currently no way for the purchaser to know whether any of the tickets given to an individual are winning tickets. Thus, some individuals may be disappointed by having no winning tickets, while other individuals may have one or more winners.

SUMMARY OF THE INVENTION

The present invention is directed to a lottery-type ticket having a winner indication that enables a purchaser or player to quickly determine whether the ticket is a winning ticket. In one embodiment, the ticket is a scratch-off ticket, and the winner indication is hidden under a scratch-off zone that is independent and separated from the playing area. If the purchaser is a player interested in fast play, the player only has to scratch off the winner indication zone to determine whether the ticket is a winning ticket. If the purchaser intends to give the ticket as a present, the purchaser can scratch off the winner indication zone to quickly determine which tickets are winning tickets, without scratching off any of the scratch-off zones in the playing area. The purchaser can then give the tickets as presents and ensure that each recipient receives a winning ticket.

In another embodiment, the ticket may be either a scratch-off ticket or a break-open ticket, and the player only has to scratch off one playing zone or open one window to determine whether the ticket is a winning ticket. The scratch-off zone or window or may be marked on the outside to identify it as the location of the winner indication. Alternatively, winning tickets may include a winner indication in each of the scratch-off zones or windows so that the winner indication is uncovered no matter which zone or window is uncovered.

Thus in one aspect, the present invention is directed to a lottery-type ticket for playing a game of chance. The ticket includes a plurality of game indicia printed on a surface of the ticket, and a winner indication printed on the surface of the ticket. The winner indication indicates whether the ticket is a winning ticket. The ticket also includes means for hiding the game indicia and the winner indication from view until the game is played. Thus, a player can quickly determine whether the ticket is a winning ticket by revealing the winner indication. The ticket may be a scratch-off ticket or a break-open ticket, and the winner indication may be printed in a single area, which may be identified to the player. Alternatively, the winner indication may be printed in proximity to each of the game indicia, enabling the player to reveal the winner indication by revealing any one of the game indicia.

In another aspect, the present invention is directed to a break-open lottery-type ticket for playing a game of chance. The ticket includes a plurality of game indicia printed on a surface of the ticket, and a plurality of pull-tab windows for covering the game indicia and hiding the game indicia from view until the game is played. Each of the pull-tab windows includes a pull-tab having a topside which is visible when the window is closed and an underside which is visible when the window is open, but not visible when the window is closed. A winner indication is printed on the underside of at least one of the pull-tabs, wherein a player can quickly determine whether the ticket is a winning ticket by raising the pull-tab having the winner indication printed on the underside thereof.

BRIEF DESCRIPTION OF THE DRAWINGS

A more complete understanding of the present invention may be had by reference to the following Detailed Description when taken in conjunction with the accompanying drawings wherein.

DETAILED DESCRIPTION OF EXEMPLARY EMBODIMENTS

The present invention is directed to a lottery-type ticket having a winner indication that enables a purchaser or player to determine whether the ticket is a winning ticket. The winner indication enables the player to determine whether the ticket is a winning ticket by scratching off or opening only a single scratch-off zone or pull-tab window.

Figure 1:
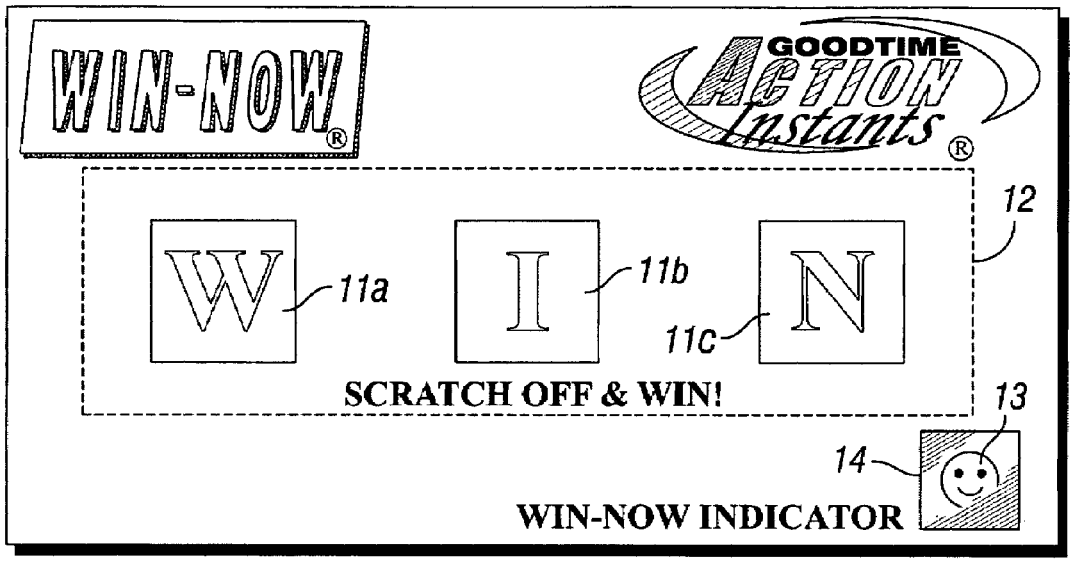
FIG. 1 is an illustrative drawing of a first embodiment of the lottery-type ticket of the present invention.

FIG. 1 is an illustrative drawing of a first embodiment of the lottery-type ticket of the present invention. In this embodiment, the ticket may be either a scratch-off ticket or a break-open ticket, although in this case, a scratch-off ticket is shown for illustrative purposes. The ticket includes a plurality of scratch-off zones 11*a*–11*c* within a playing area 12. A winner ("WIN-NOW") indication (☺) 13 is hidden under a scratch-off zone 14 that is independent and separated from the playing area 12. If the purchaser is a player interested in fast play, the player only has to scratch off the winner indication zone to determine whether the ticket is a winning ticket. If the purchaser intends to give the ticket as a present, the purchaser can quickly determine which tickets are winning tickets by scratching off the winner indication zone, without scratching off any of the scratch-off zones in the playing area. The purchaser can then give the tickets as presents and ensure that each recipient receives a winning ticket. Note that if the ticket is a break-open ticket, the scratch-off zone 14 may be a pull-tab window instead of a scratch-off zone.

In the preferred embodiment, uncovering the winner indication (☺) 13 only tells the player that the ticket is a winning ticket; it does not tell the player how much is won. Additionally, in one embodiment, the winner indication may be encoded so that it cannot be ascertained whether the ticket is a winning ticket by merely looking at the winner indication. For example, the winner indication may comprise an optical code such as a bar code, a magnetic code, a radio frequency device, or any other suitable device for encoding data that can be read by a scanner at the point of purchase. The scanner reads the encoded winner indication as an input, and outputs a human-readable indication of whether the ticket is a winning ticket. In this way, if the ticket is given as a gift, the recipient of the ticket cannot tell whether the ticket is a winning ticket without playing the game.

Figure 2:
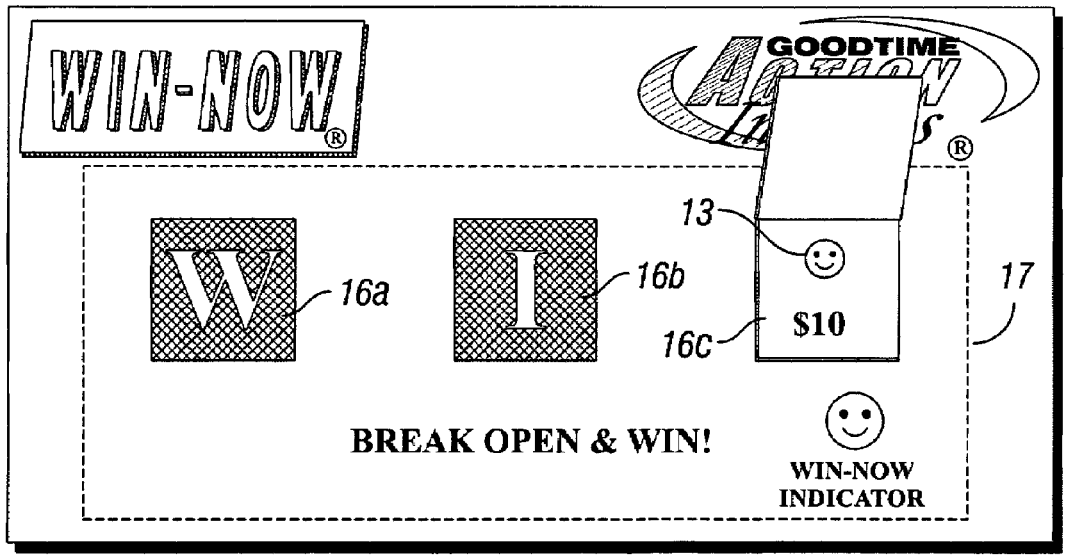
FIG. 2 is an illustrative drawing of a second embodiment of the lottery-type ticket of the present invention.

FIG. 2 is an illustrative drawing of a second embodiment of the lottery-type ticket of the present invention. In this embodiment, the ticket may be either a scratch-off ticket or a break-open ticket, although a break-open ticket is shown for illustrative purposes. The ticket includes a plurality of pull-tab windows 16*a*–16*c* within a playing area 17. The winner indication (☺) 13 is hidden under pull-tab 16*c*. In this embodiment, pull-tab 16*c* is labeled as the location of the winner ("WIN-NOW") indication (☺) 13. Thus, if the player wishes to quickly determine whether the ticket is a winning ticket, the player can open pull-tab 16*c* first. On the other hand, if the player does not wish to play quickly, but rather wishes to play slowly and enjoy the suspense of the game, the player can open pull-tab 16*c* last. Note that if the ticket is a scratch-off ticket, pull-tab 16*c* may be a scratch-off zone instead of a pull-tab window.

Figure 3:
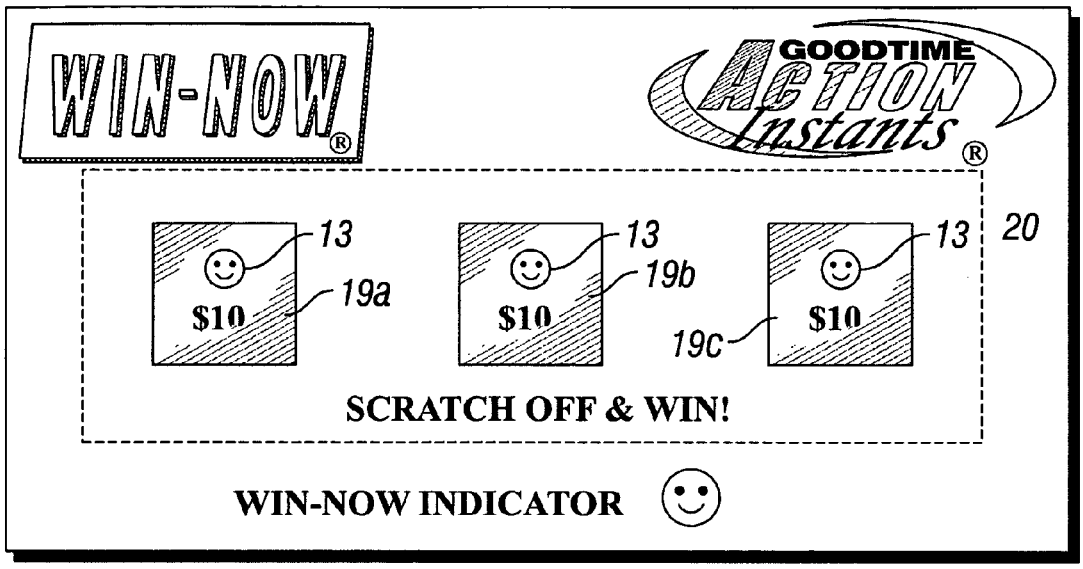
FIG. 3 is an illustrative drawing of a third embodiment of the lottery-type ticket of the present invention.

FIG. 3 is an illustrative drawing of a third embodiment of the lottery-type ticket of the present invention. In this embodiment, the ticket may be either a scratch-off ticket or a break-open ticket, although in this case, a scratch-off ticket is shown for illustrative purposes. The ticket includes a plurality of scratch-off zones 19*a*–19*c* within a playing area 20. In this embodiment, the winner ("WIN-NOW") indication (☺) 13 is included in each of the scratch-off zones so that the winner indication is uncovered no matter which zone is uncovered first. In this manner, a player interested in rapidly determining whether the ticket is a winning ticket can scratch off any single window to make that determination. Note that if the ticket is a break-open ticket, the scratch-off zones 19*a*–19*c* may be pull-tab windows instead of scratch-off zones.

Figure 4:
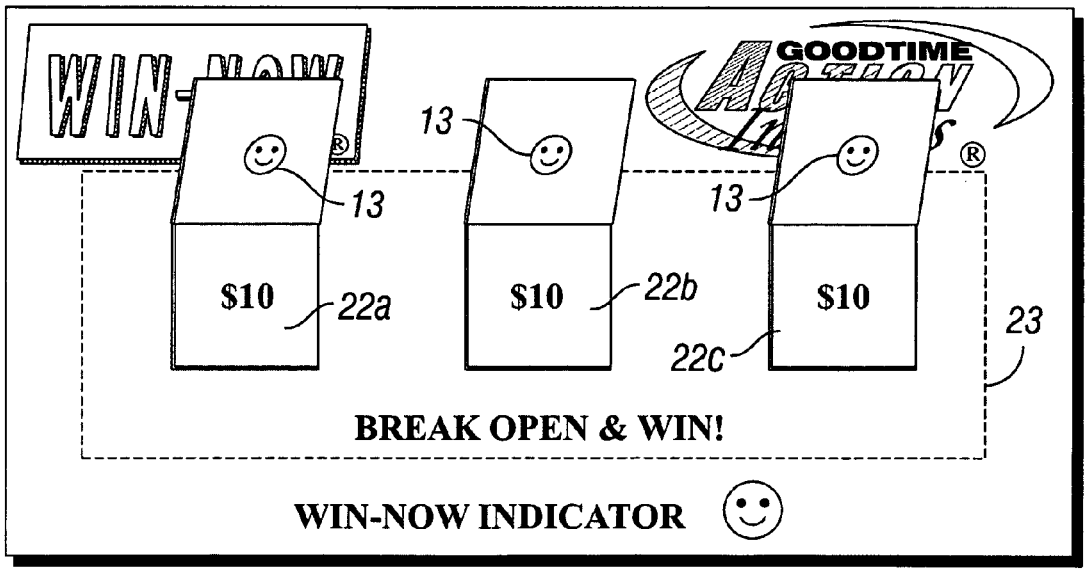
FIG. 4 is an illustrative drawing of a forth embodiment of the lottery-type ticket of the present invention.

FIG. 4 is an illustrative drawing of a forth embodiment of the lottery-type ticket of the present invention. In this embodiment, the ticket is a break-open ticket. The ticket includes a plurality of pull-tab windows 22*a*–22*c* within a playing area 23. This embodiment is similar to the third embodiment of FIG. 3 except that the winner ("WIN-NO") indication (☺) 13 is printed on the underside of the window flap, and thus becomes visible only when the flap is fully opened. Like the third embodiment, the winner indication is uncovered no matter which zone is uncovered first. Note that in any of the embodiments discussed above that utilize break-open windows, the winner ("WIN-NOW") indication (☺) 13 may alternatively be printed on the underside of the window flap instead of on the underlying surface of the ticket.

As will be recognized by those skilled in the art, the innovative concepts described in the present application can be modified and varied over a wide range of applications. Accordingly, the scope of patented subject matter should not be limited to any of the specific exemplary teachings discussed above, but is instead defined by the following claims.

What is claimed is:

1. A game ticket having a plurality of concealed game indicia for playing a game of chance, comprising:

a plurality of game indicia printed on a surface of the ticket;

a winner indication printed on the surface of the ticket in an area separated from the plurality of game indicia, said winner indication indicating whether the ticket is a winning ticket; and means for hiding the plurality of game indicia and the separate winner indication from view until the game is played;

wherein the ticket can be determined to be a winning ticket by revealing the separate winner indication without revealing any of the game indicia.

2. The game ticket of claim 1, wherein the area where the separate winner indication is printed includes means for identifying to a player, the area where the separate winner indication is located.

3. The came ticket of claim 1, wherein the separate winner indication is encoded in such a manner that a player cannot determine from the winner indication whether the ticket is a winning ticket, and the winner indication must be decoded to determine whether the ticket is a winning ticket.

4. The type game ticket of claim 1, wherein the means for hiding the plurality of game indicia and the separate winner indication from view includes opaque scratch-off material covering the plurality of game indicia and the separate winner indication.

5. The game ticket of claim 1, wherein the means for hiding the plurality of game indicia and the separate winner indication from view includes at least one pull-tab window for hiding the plurality of game indicia, and a separate pull-tab window separated from the at least one pull-tab window hiding the game indicia for hiding the separate winner indication.

6. A game ticket having a plurality of concealed game indicia for playing a game of chance, comprising:

a plurality of game indicia printed on a surface of the ticket;

a winner indication for indicating whether the ticket is a winning ticket, wherein the winner indication is located in an area associated with one of the plurality of game indicia;

means for hiding the game indicia and the winner indication from view until the game is played; and means for identifying to the player, the area where the winner indication is located, thereby enabling the player to reveal the winner indication without having to guess the location of the winner indication or reveal any of the other game indicia.

7. The game ticket of claim 6, wherein the ticket is a break-open ticket, and the means for hiding the game indicia and the winner indication includes a plurality of pull-tab windows, wherein the winner indication is printed on the underside of only one of the pull-tabs, and the ticket includes means for identifying to the player, the pull-tab window where the winner indication is located.

8. A game ticket having a plurality of concealed game indicia for playing a game of chance, comprising:

a plurality of game indicia printed on a surface of the ticket:

a plurality of winner indications for indicating whether the ticket is a winning ticket, each of the winner indications being printed on the surface of the ticket in proximity to an associated one of the plurality of game indicia; and means for hiding the game indicia and the associated winner indications from view until the game is played;

wherein a player can determine whether the ticket is a winning ticket by revealing any one of the plurality of game indicia and its associated winner indication without having to guess the location of the winner indication or reveal any of the other game indicia.

9. The game ticket of claim 8, wherein the ticket is a scratch-off ticket, and the means for hiding the game indicia and the associated winner indications includes opaque scratch-off material covering each of the plurality of game indicia and the associated winner indication.

10. The game ticket of claim 8, wherein the ticket is a break-open ticket, and the means for hiding the game indicia and the associated winner indications includes a plurality of pull-tab windows for hiding each game indicia and the associated winner indication.

11. The game ticket of claim 10, wherein each of the plurality of pull-tab windows includes a pull-tab having a topside which is visible when the window is closed and an underside which is visible when the window is open, but not visible when the window is closed and the winner indication is printed on the underside of at least one each of the plurality of pull-tabs.

12. A system for enabling a player to determine whether a game ticket is a winning ticket without altering a game-playing area of the ticket, said ticket being of the type having a plurality of game indicia printed on a surface of the ticket in the game-playing area, and having removable means for concealing the game indicia until removed by the player, said system comprising:

an encoded winner indication included on or embedded in the ticket in an area separated from the game-playing area, said winner indication being encoded in such a manner that a player cannot determine from the winner indication whether the ticket is a winning ticket, and the winner indication must be decoded to determine whether the ticket is a winning ticket; and means for decoding the encoded winner indication to determine whether the ticket is a winning ticket.

13. The system of claim 12, wherein the encoded winner indication is hidden by opaque scratch-off material until the scratch-off material is removed by the player.

14. The system of claim 12, wherein the encoded winner indication is hidden in a pull-tab window until the pull-tab window is opened by the player.

15. The system of claim 12, wherein the encoded winner indication is encoded using an encoding technique selected from a group consisting of:

an optical encoding technique;

a magnetic encoding technique; and a radio frequency encoding technique.

16. The system of claim 12, wherein the means for decoding the encoded winner indication includes a scanning device adapted to receive the encoded winner indication as an input, and to display as an output, a human-readable indication of whether the ticket is a winning ticket.

* * * * *